United States Patent [19]

Niem

[11] 4,325,314

[45] Apr. 20, 1982

[54] THREAD CONTROL MECHANISM FOR SEWING MACHINES

[75] Inventor: Wolfgang Niem, Leonberg, Fed. Rep. of Germany

[73] Assignee: Union Special G.m.b.H., Stuttgart, Fed. Rep. of Germany

[21] Appl. No.: 136,204

[22] Filed: Apr. 1, 1980

[30] Foreign Application Priority Data

Apr. 7, 1979 [DE] Fed. Rep. of Germany ..... 2914117

[51] Int. Cl.[3] ..... D05B 1/10

[52] U.S. Cl. ..... 112/199; 112/250; 112/302

[58] Field of Search ..... 112/197, 199, 200, 201, 112/202, 242, 250, 273, 278, 254, 255, 302

[56] References Cited

U.S. PATENT DOCUMENTS 2,910,951 11/1959 Irmscher ..... 112/302 X 3,683,832 8/1972 Schoij ..... 112/242

*Primary Examiner*—Peter P. Nerbun

*Attorney, Agent, or Firm*—John W. Harbst; John A. Schaerli

[57] ABSTRACT

The present invention relates to an improved thread control mechanism for chain-stitch sewing machines. The present invention is adapted to apply a quick and effective clamping action to the sewing thread of the machine in timed relation with the rotary or oscillatory movements of the stitch forming instrumentalities. The mechanism's clamping force magnitude may be selectively regulated to exceed the tensile strength of the particular thread being used and is effective to break the thread should it become wound about an operable rotary shaft of the machine. The present invention includes a rotary actuating member for moving a thread engaging member between two extreme positions so as to entrap and intermittently clamp the thread at a location interposed between the stitch forming instrumentalities and the thread supply source.

8 Claims, 3 Drawing Figures

THREAD CONTROL MECHANISM FOR SEWING MACHINES

FIELD OF THE INVENTION

This invention relates, in general, to new and useful improvements in sewing machines and, more particularly, to a thread control mechanism for chain-stitch sewing machines.

BACKGROUND OF THE INVENTION

Thread control in sewing machines is a very important consideration in the formation of a good stitch. In sewing machines employing oscillatory rocking loopers, a rotary thread take-up mechanism is usually employed to manipulate the looper thread as demanded by the oscillatory lengthwise movement of the looper. While the looper is moving toward the needle, the take-up mechanism allows a certain degree of slack in the thread system to allow the previous formed stitch to be set properly. During operation, the thread take-up mechanism is effective to create a loop in the looper thread so as to take-up the slack of the looper thread when the looper is returning to its initial position. During the return movement of the looper, and once all the slack has been removed from the system, the take-up mechanism is effective to pull or draw thread from the cone or supply source. Prior to the time the looper returns to its initial position, the looper thread will be "cast off" the high point of the looper thread take-up cam. After the thread has been cast off from the take-up cam, still further thread is delivered into the system between the take-up cam and the looper because of the continuing return motion of the looper. It should be noted that the required amount of looper thread for the next stitch was also drawn into the system before the thread was cast-off the high point of the take-up. To prevent the rotary thread take-up from drawing thread from the supply source, rather than from the looper on the return movement of the latter, it has been known to position a thread brake mechanism between the take-up mechanism and the thread supply. These thread brakes are effective only when the take-up mechanism is manipulating the looper thread into a loop during the reverse movement of the looper. During the withdrawal of the thread from the supply, the thread brake is open.

Such thread brake mechanisms have the disadvantage of not controlling the slack or excessive looper thread that results in the system once the looper thread is cast off from the take-up. It is when the looper thread is cast off from the take-up, thus resulting in an excessive amount of lose thread in the system that the looper thread has a tendency to wind around the take-up mechanism, thus drawing excessive amounts of thread from the supply. As mentioned, during this period of the cycle, the heretofor known thread brakes are ineffective and, thus, the thread is quickly spooled around the rotary shaft that is adapted to drive the take-up mechanisms. Before the machine is returned to operation, this wound up thread must be removed from the shaft to enable use of the machine. On many machines, the take-up area is inaccessible. Thus, the problem of removing the wound thread from about the rotary shaft is a timely and costly process.

The present invention involves a thread control mechanism which has the ability to apply a quick and effective clamping action to the sewing machine thread at an appropriate time interval so as to prevent the thread from winding around an operative rotary drive shaft of the machine. The clamping force magnitude of the instant invention may be selectively regulated to exceed the tensile strength of the thread. Thus, if thread is drawn from the supply as a result of it winding around the shaft, the present invention causes a break in the thread. In this manner, rather than drawing thread from the supply cone, the thread is torn or bursts and thread wind-up about an operative mechanism of the machine is eliminated. The instant thread control mechanism operates in timed relation with the stitch forming element of the machine so that it allows thread to be drawn from the supply when necessary and clamps same only when necessary. Thus, stitch formation is not affected by the present invention but a spooling up of the thread about an operable mechanism is eliminated.

The present invention includes a thread engaging member adapted to intermittently apply a clamping force to the thread. A circulatory moving actuator is effective to move a thread engaging member into contact with the thread in timed relation to the reciprocatory or oscillatory movements of the machine's stitch forming elements. The circulatory actuator may be in the form of an eccentric that is carried on the same shaft as the rotary disk take-up and, thus, may be set in timed relation thereto. Because loopers have different amounts of endwise travel and, thus, different thread demands, the clamping action and activation of the instant invention may require that various types of eccentrics be used according to the requirements of the thread and looper travel.

In line with all of the above, it is the primary object of this invention to provide suitable means which will prevent looper thread from spooling up about the looper thread take-up mechanism of the machine.

It is another object of this invention to provide a thread control mechanism which is relatively simple in construction, dependable in operation, and is suited in use in connection with industrial sewing machines.

Yet another object of this invention is to provide a thread control mechanism which is versatile for use with machines having various degrees of looper travel.

BRIEF DESCRIPTION OF THE DRAWINGS

Having in mind the above objects and other attendant advantages that would be evident from an understanding of this disclosure, the invention comprises the devices, combinations and arrangements of parts as illustrated in the presently preferred embodiment of the invention which is hereinafter set forth in detail so as to enable those skilled in the art to readily understand the functions, operation, construction and advantages of it when read in conjunction with the accompanying drawings in which.

DETAILED DESCRIPTION OF THE PRESENT INVENTION

Figure 1:
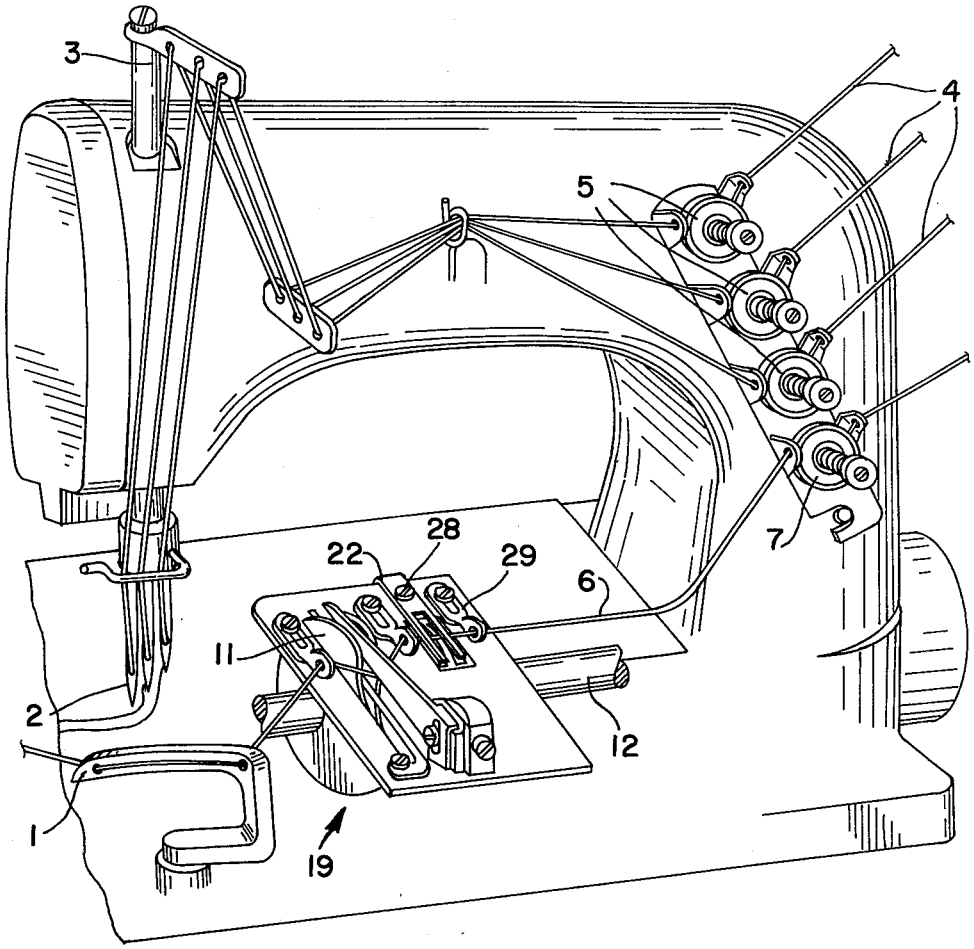
FIG. 1 is a schematic showing of a sewing machine illustrating the present invention.
Figure 2:
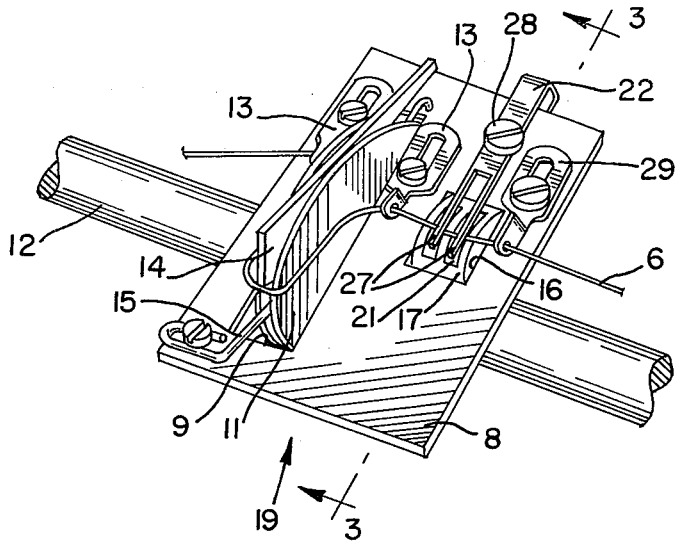
FIG. 2 is an enlarged perspective view of the present invention.

Referring to the drawings, wherein like reference numerals indicate like parts throughout the several views, only so much of a sewing machine is shown as is deemed necessary to illustrate the application and mode of operation of a presently preferred embodiment of the invention. The sewing machine in which the present invention is embodied is a chain stitch sewing machine including a series of mechanisms for actuating suitable stitch forming instrumentalities in timed relation relative to one another so as to concatenate a thread or series of thread into a stitch. Although the present invention is illustrated for use with a lower stitch forming instrumentality, it should be appreciated that the principle of the present invention is equally applicable to other stitch forming instrumentalities. As shown in the drawings, the machine is provided with thread carrying looper means 1 driven from a rotary shaft 12 and movable in timed relation with suitable thread carrying needle means 2 so as to form a stitch. For purposes of clarity, the actuating mechanisms for these elements have not been shown, albeit any suitable well known mechanism would suffice. The looper means 1 of the machine partake of oscillation lengthwise of the looper for seizing and shedding the needle thread loops as well as oscillation sideways to partake of needle avoiding movement. Supported for endwise reciprocation in the sewing head is a needle bar 3 having the needle means 2 detachably secured at its distal end.

The needle threads 4 run from a thread supply (not shown) through suitable thread tension elements 5, through a series of eyelets and to the needle means 2. Likewise, the looper thread 6 is supplied from a suitable source (not shown) from which it passes through a suitable thread tension device 7 and is delivered to the looper means 1.

The sewing machine is further provided with a looper thread take-up assembly generally designated 20. It comprises a series of thread cams or discs 11 mounted upon a shaft 12 and projecting upwardly through a suitable opening 9 in the carrier plate 8. Adjustably secured to the carrier plate 8, on opposite sides of the thread cams 11 are thread guides 13 which are adapted to accomodate the looper thread 6. A stripping finger 14 and a thread detainer 15 are arranged between the cammed discs 11 for the purpose of controlling, in a well known manner, the looper thread 6.

In the presently preferred embodiment, the thread control mechanism is arranged in close proximity to the looper thread take-up means 11, but it should be appreciated that it could be positioned at other localities as long as it remains interposed between the looper thread supply and the take-up means. The present invention includes a thread engaging means 17, a peripheral portion of which projects upwardly through a suitable opening 16 in the carrier plate 8. The engaging means 17 is adapted to move between two extreme positions as a result of the movement of a circularly moving actuator 19. In the preferred embodiment, the actuator 19 is in the form of an eccentric arranged on the shaft 12 so as to move the thread engaging means in timed relation with the movements of the looper or, if preferred, the rotary movements of the looper thread take-up mechanism. Suitable anti-friction bearings 18 may be interposed between the actuator 19 and the thread engaging means 17. A series of slits or indentations 21 are formed about the periphery of the thread engaging means extending through the opening 16 so as to create a comb-like surface along that portion of the thread engaging means 17. Furthermore, the engaging means is formed with a flat 25 on one side thereof for purposes described hereinafter.

Figure 3:
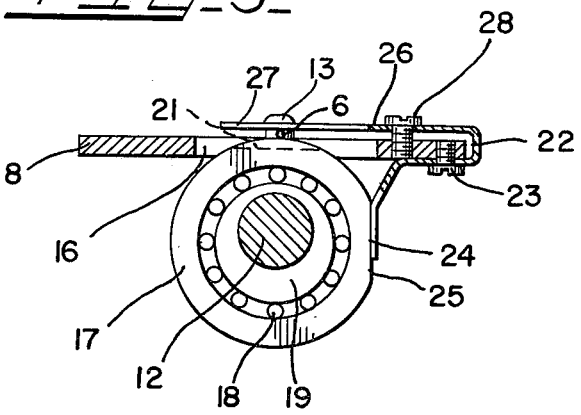
FIG. 3 is a fragmentary sectional view taken along line 3—3 of FIG. 2.

Also mounted on the carrier plate 8 is a leaf spring 22 which is adjustably secured to the plate 8 by a screw 23 (FIG. 3). The leaf spring 22 is provided with two arms or shanks 24 and 26. The shank 24 depends from the plate 8 and is adapted to engage the flat 25 on the thread engaging member 17 so as to prevent the latter from rotating with the eccentric 19. In this manner, the thread engaging member 17 is confined to movement in linear or up and down directions. The adjustability of the leaf spring 22 allows the arm 24 to be adjustably regulated so as to compensate for the position of the flat 25 on the engaging member 17. The forward and free end of the other arm 26 is provided with a series of finger like projections 27 that are adapted to mutually engage with the elongated recesses 21. The fingers 27, of course, correspond in number to the elongated recesses provided on the thread engaging means. The resiliency of the arm 26 may be selectively regulated by an adjustable means which, in the preferred embodiment, is the form of a screw 28 which engages against the upper surface of arm 26. A thread accomodating guide means 29 is disposed beside the thread control mechanism on the opposite side from thread guide 13 so as to assure that the looper thread 6 will pass under and between the finger like projections 27 and the thread engaging member 17.

When the machine is in operative condition, the looper thread traverses a path from the thread supply through the thread accomodating eyelets 13, 29 and under the free end of leaf spring 22. The looper thread is allowed to move freely through the thread control mechanism of the present invention when the engaging member is in one position. When the thread engaging member is moved to its other position, through the action of the actuator 19, the looper thread is deflected in a meander form by passing same over the elongated recesses 21 but under the finger like projections 27. When moved so as to deflect the looper thread, the engaging member 27 is effective to quickly and effectively clamp the looper thread so as to prevent its movement through the thread control mechanism. It should be noted that the clamping force magnitude exceeds the tensile strength of the thread so that the latter will break should it become tensioned through a windup action about the thread take-up means 11. The adjustable member 28 allows the clamping force magnitude to be selectively adjusted according to the requirements of the thread being used. Moreover, the eccentricity of the actuator 19 further determines the clamping action interval which may be dependent upon the looper travel desired. Because of its disposition between the thread supply and the take-up, the instant thread control mechanism will effectively eliminate any excessive amounts of looper thread from being wound about the thread take-up mechanism of the machine by bursting or braking same as a result of the clamping action.

Thus, it is apparent that there has been provided, in accordance with the invention, a looper thread tension assembly that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and scope of the appended claims.

What is claimed:

1. In a sewing machine having stitch forming instrumentalities adapted to form a thread into a stitch during a sewing cycle, a series of mechanisms for actuating said stitch forming instrumentalities in timed relation to each other and a thread control mechanism comprising:

means operable to effectively clamp the thread being used for a predetermined period of time during the stitch forming cycle and effective to burst said thread as a result of the clamping action when said thread inadvertently became entangled with said actuating mechanism.

2. Sewing apparatus including a machine having reciprocal thread carrying needle means, oscillatory rocking thread carrying looper means, rotary drive shaft means for moving said looper means in timed relation to said needle means so as to form a stitch, a supply of thread for said looper means and a thread control mechanism comprising:

means operable in timed relation with the movements of said looper means for intermittently clamping the thread passing to said looper means at a point located between said thread supply and said looper and effective to break said looper thread when it becomes entangled with said rotary drive shaft means.

3. Sewing apparatus including a machine having thread carrying looper means movable in reciprocating endwise directions, looper thread take-up means effective to manipulate a loop of thread in accordance with the reciprocal movements of said looper means and a thread control mechanism comprising:

means operable in timed relation to the reciprocal endwise movements of said looper means for intermittently clamping said looper thread with a magnitude greater than the tensile strength of said looper thread and effective to break said looper thread as a result of such clamping action when it becomes inadvertently entangled with said looper thread take-up means.

4. Sewing apparatus including a machine having reciprocal thread carrying needle means, oscillatory rocking thread carrying looper means movable in timed relation with the needle means for forming a stitch, stationary thread guide means for accomodating a thread passing from a thread supply source to said looper means, movable thread take-up means effective to manipulate a loop of thread between said stationary thread guide means in accordance with the rocking movements of said looper means and a thread control mechanism comprising:

means movable in timed relation with said movable thread take-up means and disposed between the latter and said thread supply source for clamping the looper thread with a force greater than the thread's tensile strength for a predetermined interval during the stitch forming cycle.

5. In a sewing machine having endwise reciprocal thread carrying looper means adapted to move in timed relation with thread carrying needle means in the formation of a stitch, stationary thread guide means for accomodating the thread passing from a thread supply source to said looper means, rotatable thread take-up means for manipulating a loop of looper thread between said stationary guide means during the reciprocal movements of said looper means and a thread control mechanism comprising:

means operatively interposed between said rotary take-up means and said thread supply for intermittently engaging and clamping said looper thread with a force having a magnitude greater than the tensile strength of said looper thread; and circulatory moving actuator means arranged to move said engaging and clamping means in timed relation with the movement of said rotary thread take-up means.

6. A sewing machine according to claim 5 wherein said engaging and clamping means clamp said looper thread with a meander form.

7. In a sewing machine having endwise reciprocal thread carrying looper means adapted to move in timed relation with thread carrying needle means in the formation of a stitch, stationary thread guide means for accomodating the thread passing from a thread supply source to said looper means, rotatable thread take-up means for manipulating a loop or looper thread between said stationary guide means during the reciprocal movements of said looper means and a thread control mechanism comprising:

stationary spring biased means arranged between said rotary take-up means and said thread supply; thread engaging member means adapted to move toward and away from said spring biased means, the spring biased means and said member means including mutually engageable parts by means of which the looper thread may be intermittently clamped with a force having a magnitude greater than the tensile strength of said looper thread; and circularly moving actuator means arranged to move said member means into a thread clamping relationship with said spring biased means in timed relation with the movement of said rotary thread take-up means.

8. A sewing machine according to claim 7 wherein the spring biased means may be selectively regulated according to the looper thread requirements.

* * * * *